United States Patent [19]

Swisher, Jr. et al.

[11] 4,290,820

[45] Sep. 22, 1981

[54] METHOD AND APPARATUS FOR COLLECTING PARTICULATE MATERIAL ON A ROADWAY

[75] Inventors: George W. Swisher, Jr.; Thomas L. Steele, both of Oklahoma City; Richard A. Silbernagle, Moore, all of Okla.

[73] Assignee: CMI Corporation, Oklahoma City, Okla.

[21] Appl. No.: 103,455

[22] Filed: Dec. 14, 1979

Related U.S. Application Data

[63] Continuation-in-part of Ser. No. 10,022, Feb. 7, 1979, abandoned.

[51] Int. Cl.[3] ..... B08B 7/00

[52] U.S. Cl. ..... 134/6; 15/83; 15/340; 37/190; 56/328 R; 134/21; 198/514; 198/518

[58] Field of Search ..... 15/83, 84, 85, 86, 87, 15/340; 198/514, 518; 56/328 R; 37/190, 189, 43 R, 43 D, 12; 172/33; 404/83, 112; 134/6, 21

[56] References Cited

U.S. PATENT DOCUMENTS

| | | | |
|---|---|---|---|
| 527,757 | 10/1894 | Miller | 15/84 |
| 866,263 | 4/1908 | Smith | 15/84 |
| 981,652 | 1/1911 | D'Homergue | 15/84 |
| 1,142,415 | 6/1915 | Gardener | 15/84 |
| 1,238,681 | 8/1917 | Kaplan | 15/84 |
| 1,790,811 | 2/1931 | Haiss | 198/518 |
| 2,612,980 | 10/1952 | Oehler | 198/518 |
| 2,657,408 | 11/1953 | Machovec | 15/83 |
| 2,669,338 | 2/1954 | Kling | 37/190 |
| 3,107,475 | 10/1963 | Gustafson | 56/328 R |
| 3,626,677 | 12/1971 | Sides | 56/328 R |
| 3,766,586 | 10/1973 | Krickovich | 15/83 |
| 3,802,020 | 4/1974 | Stone et al. | 15/84 |

FOREIGN PATENT DOCUMENTS

| | | | |
|---|---|---|---|
| 1202305 | 8/1970 | United Kingdom | 15/83 |

OTHER PUBLICATIONS

"Athey Force-Feed Loader", 1945, by Athey Truss Wheel Co.

*Primary Examiner*—Michael L. Goldman
*Attorney, Agent, or Firm*—Dunlap, Codding & McCarthy

[57] ABSTRACT

An improved front-end loader apparatus for collecting particulate material on a roadway surface comprising a frame assembly drivingly supported on the roadway, a windrow formation assembly supported at the forward end of the frame assembly for brushing particulate material into a windrow, and a feeder assembly disposed to engage the windrowed material up and onto a roadway scraper blade supported at the forward end of the frame assembly. An elevator assembly is disposed to receive the particulate material from the feeder assembly and elevate the material to a rear overhead discharge position. A residual material cleaning assembly is supported beneath the frame assembly and rearward to the feeder assembly for cleaning up residual material not collected by the feeder assembly, the residual material cleaning assembly directing the residual material to the elevator assembly so that the residual material is elevated to the rear overhead discharge position.

36 Claims, 5 Drawing Figures

METHOD AND APPARATUS FOR COLLECTING PARTICULATE MATERIAL ON A ROADWAY

REFERENCE TO RELATED APPLICATIONS

This application is a continuation-in-part of copending patent application U.S. Ser. No. 10,022, filed Feb. 7, 1979 and entitled "IMPROVED FRONT-END LOADER FOR PARTICULATE MATERIAL OR THE LIKE", now abandoned.

BACKGROUND OF THE INVENTION

1. Field of the Invention

The present invention relates to the field of material handling devices generally referred to as front-end loaders, and more particularly, but not by way of limitation, to a front-end loader apparatus for removing particulate material from a roadway surface or the like.

2. Discussion of Prior Art

In U.S. Pat. No. 4,139,318 entitled "A Method and Apparatus for Planing a Paved Roadway", issued Feb. 13, 1979, and assigned to the assignee of the present invention, a unique approach to the maintenance of paved roadways was introduced. That is, that patent taught the planing of roadways to remove a top portion of the roadway in a controlled fashion to expose a new planed surface having a predetermined grade and cross-slope, a practice which has now become widespread in the maintenance of paved roadway surfaces, and which forms the background to the present invention.

The process of roadway planing is described in the above-mentioned patent, but a review of that process may prove helpful to an understanding of the present invention. As a planing cutter engages a paved roadway surface, the contacted edge of the surface is pulverized by the planing cutter, and in the wake of the cutter, if the removed material is not collected, there is formed a newly exposed planed surface covered by the debris of the removed surface material, which is in a granular or particulate form.

A reclaimer assembly may be supported behind the planer cutter to receive the debris material removed by the cutter. Such a reclaimer assembly may be a floating scraper and a conveyor assembly that gathers and elevates the debris to an overhead discharge point from which the lifted debris is put into waiting trucks positioned below. However, this arrangement may not be entirely satisfactory, because practical experience has been that the progress of the planing apparatus is often interrupted while waiting for trucks to arrive. It is usually not economical to furnish the large number of removal trucks that is necessary to assure that a truck is always available for loading the material elevated by the reclaimer assembly. In addition to the small amount of time required to remove a loaded truck and to appropriately position a new truck for loading, the amount of time expended for trucks to travel to and from unloading sites must be taken into account and trucks scheduled accordingly. Since construction work is usually not manageable with absolute precision, it is frequently the case that trucks will stack up and be waiting for a load, or that there will be periods of time during which no trucks are available for receiving debris from the planing apparatus.

To alleviate the scheduling problem encountered with trucks, it would be desirable to leave the debris material on the newly exposed planed surface for disposal by means separate from the planing operation.

However, until the present invention, there has not been an apparatus available that is completely satisfactory for cleaning up scattered particulate material of the type left behind a roadway planing apparatus.

There are a number of prior art devices that fall in the general category of street sweepers which are effective for cleaning up dust and the like on street surfaces. A variety of such devices are taught in the patents to Beyerstedt, U.S. Pat. No. 3,186,015, "Street Sweeper"; Dear, et al., U.S. Pat. No. 2,960,708, "Road Sweeping Machines"; Martin, U.S. Pat. No. 1,452,307, "Gutter Broom Arrangement for Street Sweepers"; Finch, U.S. Pat. No. 1,085,676, "Street Sweeper"; Blaney, U.S. Pat. No. 1,209,384, "Street Sweeping Machine"; Leach, et al., U.S. Pat. No. 1,566,107, "Street Sweeping Mechanism"; Dempster, et al., U.S. Pat No. 2,725,584, "Street Sweeper"; and Gehman, et al., U.S. Pat. No. 3,186,016, "Street Sweeping Machine". These patents show various combinations of rotating transverse and gutter brooms for picking up street dirt and debris, and as such, are designed to deal with light material in relatively small quantities; none of the machines have the capability of efficiently collecting and picking up the large amount of concrete or asphaltic cuttings generated by the modern planing device discussed above.

There have been machines taught in the prior art for excavating and removing dirt, such as in the patents to Bernotas, et al., U.S. Pat. No. 3,466,765, "Self-Loading Scraper"; Crum, U.S. Pat. No. 3,805,420, "Elevating Conveyor Mechanism"; Reinhardt, U.S. Pat. No. 3,738,028, "Earth Moving Apparatuses and Process"; and Carston, U.S. Pat. No. 2,844,892, "Excavating, Loading and Carry-Off Earth Working Machine". Such excavating machines are not useful in collecting and removing particulate material laying on a paved road substrate, as such machines contemplate excavating dirt using a cutter blade assembly.

There is a line of machines available in the prior art that function to scoop up and remove windrowed or otherwise gathered material from roadway-type road surfaces. Such devices are referred to as front-end loaders, or excavating loaders. Such other machines are taught in the patents to MacDonald, U.S. Pat. No. 3,680,233, "Continuous Excavating Loader With Pivotal Discharge Conveyor", and U.S. Pat. No. 3,049,817, "Roadway Machine". Another machine of this type, useful for picking up windrowed material, is the force-feed loader manufactured as Athey Model No. 7-12 by Athey Products Corporation, Raleigh, N.C. The Athey Loader features a front mounted feeder that scoops up material and forces the material onto an inclined conveyor that elevates the material to a rear, overhead discharge point. Also known in the prior art are modifications made by some contractors of the Athey Model No. 7-12 consisting of a pair of brushes disposable on a roadway ahead of the inclined conveyor. The brushes are used to sweep particulate material scattered on the roadway into a position to be received by the conveyor.

SUMMARY OF THE INVENTION

The present invention provides a front-end type loader apparatus which comprises a frame assembly having a main frame that is supported by a drive assembly for selective motion along a collection path on a roadway surface, along which, in contemplation of the present invention, particulate material is disposed. A windrow formation assembly is supported at the forward end of the main frame for incorporating particulate material on the roadway into a windrow substantially coincident with the collection path.

A material transport assembly is supported by the main frame for moving the coarser particulate material from the windrow rearward and upward into the frame assembly into an overhead discharge position. Also disposed on the main frame is a residual material cleaning assembly for collecting the finer residual particulate material not collected from the windrow by the material transport assembly. The residual material cleaning assembly moves the collected residual material to a discharge point, where it is received by the material transport assembly. Thus, both the coarse and fine debris material scattered on the roadway surface are collected and elevated to an overhead discharge position.

Accordingly, it is an object of the present invention to provide a loading apparatus for collecting particulate material disposed along a roadway surface.

It is another object of the present invention, while achieving the above-stated object, to provide a multipurpose loader apparatus which efficiently collects both coarse and fine particulate material disposed along a roadway surface.

Another object of the present invention is to provide a loading apparatus, while achieving the above-stated objects, which offers ease of manufacture, operation and maintenance.

Other objects, features and advantages of the present invention will become clear from the following detailed description of the preferred embodiments when read in conjunction with attached drawings and appended claims.

DESCRIPTION OF THE PREFERRED EMBODIMENT

Figure 1:
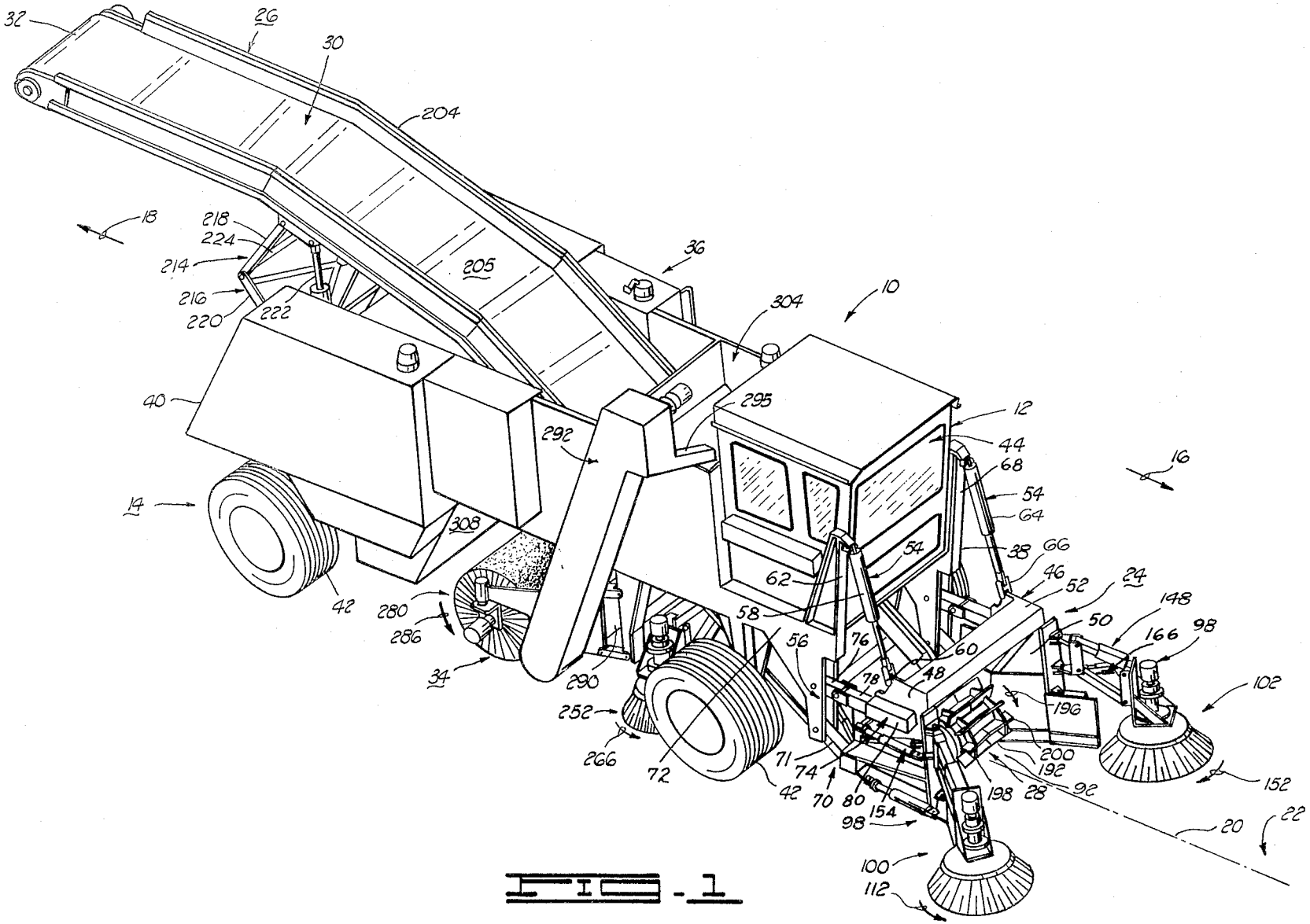
FIG. 1 is an isometric view of a front-end loader apparatus constructed in accordance with the present invention.

Referring to the drawings in general, and particularly with reference to FIG. 1, shown therein and designated by the reference numeral 10 is a front-end loader apparatus constructed in accordance with the present invention. While a detailed description will be provided hereinbelow, a general description of the components which comprise the front-end loader apparatus 10 may assist in an understanding of the construction of the front-end loader apparatus 10.

The front-end loader apparatus 10 comprises a frame assembly 12 which is supported by a drive assembly 14 for moving the frame assembly 12 in a forward direction 16 and in a rearward direction 18 along a collection path 20 on a roadway surface 22.

A windrow formation assembly 24 is supported by the frame assembly 12 in a manner such that components thereof sweepingly engage the roadway surface 22 for brushing particulate material into a windrow as the frame assembly 12 is driven forward. When the front-end loader apparatus 10 is used to collect road debris such as that left by a planar apparatus, which will ordinarily deposit the debris in a partially windrowed form, the windrow formation assembly 24 will function to incorporate unwindrowed debris into the pre-existing windrow left by the planer apparatus. In this case, the collection path 20 of the frame assembly 12 would be selected to coincide with the pre-existing windrow, for optimum ease of collecting action.

A material transport assembly 26 is supported by the frame assembly 12 and functions to collect and move windrowed particulate material to an overhead discharge position on the frame assembly 12. The material transport assembly 26 comprises a feeder assembly 28 and an elevator assembly 30. The feeder assembly 28 scoops up substantially all of the coarse material in the windrow, as well as a portion of the fine material therein, and moves the scooped material to the elevator assembly 30. Also supported by the frame assembly 12, the elevator assembly 30 functions to move particulate material received from the feeder assembly 28, by conveyor action, upward and rearward on the frame assembly 12 to an overhead discharge end 32 where the material may be dropped into a waiting collection receptacle, such as a truck (not shown).

A residual material cleaning assembly 34, supported by the frame assembly 12, functions to collect fine particulate material not scooped from the roadway surface 22 by the feeder assembly 28. The residual material cleaning assembly 34 conveys the collected particulate material to a residual discharge point where the material may be dropped onto the elevator assembly 30.

As will become clear with the description that follows, the front-end loader apparatus 10 has the capability, via the windrow formation assembly 24, of windrowing scattered particulate material encountered by the front-end loader apparatus 10 as it is driven along the collection path 20. The feeder assembly 28 picks up the bulk of the particulate material in the windrow, with the remaining uncollected fine material being cleaned up by the residual material cleaning assembly 34. Material collected by the feeder assembly 28 and the residual material cleaning assembly 34 is discharged onto the elevator assembly 30, which carries the material upwards and to the rear of the frame assembly 12, where the material is dropped into waiting trucks. A more detailed description of each of these component assemblies will now be undertaken.

The frame assembly 12 consists of a main frame 36 that is generally a longitudinal member having a forward end 38 and a rearward end 40. The main frame 36 is supported by the previously discussed drive assembly 14, part of which is represented by the wheels 42 which support the main frame 36 via conventional axle and connector mechanisms. A conventional power plant, such as a diesel engine (not shown), and conventional hydraulic pump and transmission means (not shown) are provided for moving the frame assembly 12 in the forward direction 16 and the rearward direction 18. The frame assembly 12 has a cab unit 44 having conventional operator controls (not shown) disposed therein to enable an operator to selectively drive the frame assembly 12 via the drive assembly 14 along the roadway surface 22 for the purpose of collecting particulate material disposed thereon.

Figure 2:
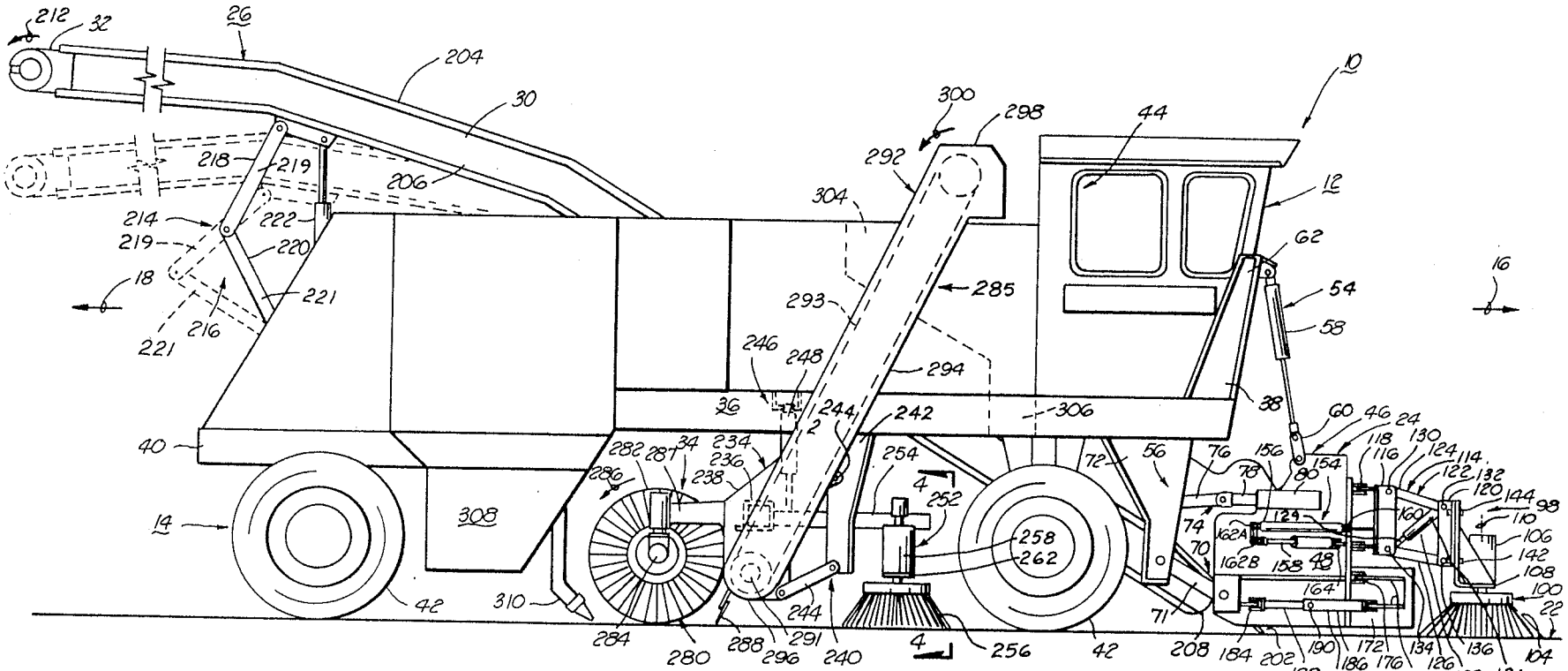
FIG. 2 is a side elevational view of the front-end loader apparatus of the FIG. 1.
Figure 3:
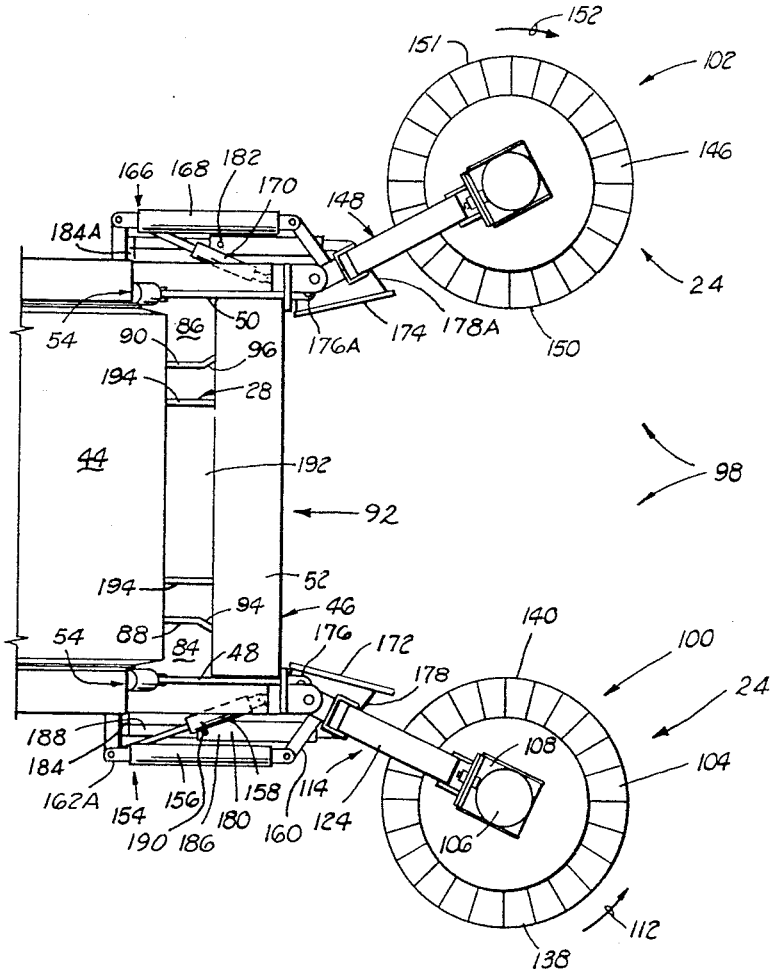
FIG. 3 is a partial top view of the front-end loader apparatus of FIG. 1 showing the windrow formation assembly and a portion of the material transport assembly. The forward connecting assemblies have been omitted from the Figure in order to better show the components of the other assemblies.

The windrow formation assembly 24, shown in FIGS. 1, 2 and 3 in semi-detailed, schematic representation, comprises a brush-supporting forward subframe 46 having a first side member 48 and a second side member 50 which are generally parallel to each other and rigidly interconnected via a first cross beam member 52. The brush-supporting forward subframe 46 is pivotally connected to the frame assembly 12 via a forward subframe positioning assembly 54 and a first forward connecting assembly 56.

The forward subframe positioning assembly 54 comprises a first hydraulic cylinder 58 and a second hydraulic cylinder 64. The first hydraulic cylinder 58 is pivotally connected at one end thereof to the first side member 48 of the brush-supporting forward subframe 46 via a linking member 60; and the other end of the first hydraulic cylinder 58 is pivotally connected to an upwardly extending support member 62 attached to the first side of the main frame 36. In like manner, the second hydraulic cylinder 64 is pivotally connected at one end thereof to the second side member 50 of the brush-supporting forward subframe 46 via a linking member 66; and the other end of the second hydraulic cylinder 64 is pivotably connected to an upwardly extending support member 68 attached to the opposed second side of the main frame 36. The first and second hydraulic cylinders 58, 64 are connected in parallel to a conventional hydraulic power source (not shown) so that the piston rods of the first and second hydraulic cylinders 58, 64 may be extended or retracted as required to position the brush-supporting forward subframe 46 at a selected vertical elevation with respect to the roadway surface 22. By varying the vertical elevation of the brush-supporting forward subframe 46, the brush-supporting forward subframe 46 may be moved between an extended mode (in which the brush-supporting forward subframe 46 is in a roadway sweeping position as depicted in FIG. 1) and a retracted mode (in which the brush-supporting forward subframe 46 is in a raised position).

Also connecting the brush-supporting forward subframe 46 to the main frame 36 is a first forward connecting assembly 56. As depicted in FIGS. 1 and 2, the first forward connecting assembly 56 comprises a lower connecting assembly 70 and an upper connecting assembly 74. The lower connecting assembly 70 comprises a rigid member 71 pivotally connected at one end to the first side member 48 of the brush-supporting forward subframe 46 and at its other end to a right-hand forward support member 72 extending beneath the main frame 36. The upper connecting assembly 74 comprises a first member 76 pivotally connected at one end to the right-hand forward support member 72 and pivotally connected at its other end to the clevis-shaped end of a second member 78, which is secured in a yoke member 80 mounted on the first side member 48 of the brush-supporting forward subframe 46. It will be understood that the pivoting connections of the first forward connecting assembly 56 permit the brush-supporting forward subframe 46 to assume a selected elevation above the roadway surface 22, as established by the forward subframe positioning assembly 54. In this regard, it should be noted that the upper connecting assembly 74 functions as a horizontal subframe adjusting apparatus, for maintaining the brush-supporting forward subframe 46 in substantially parallel relationship to the roadway surface 22, as required for optimum sweeping action by the windrow formation assembly 24. This adjustment is accomplished by drawing the second member 78 in or out of the yoke 80 to the extent required to orient the brush-supporting forward subframe 46 in parallel relationship to the roadway surface 22. In like manner, a second forward connecting assembly (not shown) comprises an upper connecting member (not shown) and a lower connecting member (also not shown). The second forward connecting assembly is substantially identical in construction to the first forward connecting assembly 56. The second forward connecting assembly connects the second side member 50 of the brush-supporting forward subframe 46 to a left-hand forward support member (not shown) extending downwardly from the main frame 36.

As depicted in FIG. 3, a pair of horizontally extending scoop members 84 and 86 are attached respectively to the first side member 48 and the second side member 50 of the brush-supporting forward subframe 46, the horizontally extending scoop members 84 and 86 extending inwardly from the first and second side members 48, 50 and convergently attaching to vertically extending members 88 and 90 which serve to outline a central feeder cavity 92. A pair of vertically extending angle members 94 and 96 attach respectively to the members 84, 88 and 86, 90 in the manner depicted in FIG. 3, so as to further frame and form the feeder cavity 92. The angle members 94 and 96 serve to form the feeder cavity 92 effectively into a material chute, as will become clear with the discussion which follows.

The windrow formation assembly 24 further comprises a parallel brush assembly 98. The parallel brush assembly 98 comprises a first forward brush assembly 100 and a second forward brush assembly 102. The first forward brush assembly 100 is supported from the first side member 48 of the brush-supporting forward subframe 46; and the second forward brush assembly 102 is supported from the second side member 50 of the brush-supporting forward subframe 46. The first forward brush assembly 100 comprises a right or first forward brush 104 of the type sometimes referred to as a gutter brush, and a hydraulic motor 106 connected to a brush shaft. The motor 106, supported by a platform member 108, is operable via high pressure hydraulic fluid (supplied by conduits not shown) to rotate the first forward brush 104 about a substantially vertical rotational axis 110 (shown in FIG. 2) in a counterclockwise rotational direction indicated by the arrow 112 in FIGS. 1 and 3.

Referring now to FIGS. 2 and 3, a first forward linkage assembly 114 connects the platform member 108 of the first forward brush assembly 100 to the brush-supporting forward subframe 46. The first forward linkage assembly 114 comprises a first right-hand vertical member 116 and a second right-hand vertical member 120. The first right-hand vertical member 116 is pivotally connected to the brush-supporting forward subframe 46 via pivot connectors 118; and the second right-hand vertical member 120 is attached to the platform member 108 of the first forward brush assembly 100. The first forward linkage assembly 114 further comprises a first parallelogram linkage 122 disposed between and interconnecting the first and second right-hand vertical members 116, 120 so that the rotational axis 110 of the first forward brush 104 is disposed substantially vertically when the forward positioning subframe 54 is positioned in an extended mode adjacent to the roadway surface 22.

As was discussed previously, the upper connecting assembly 74 of the forward subframe positioning assembly 54 functions as a horizontal subframe positioning apparatus and permits fine adjustments in the angular orientation of the brush-supporting forward subframe 46. Thus, for a given extension of the forward subframe positioning assembly 54, the brush-supporting forward subframe 46 may, by appropriate extension of the second member 78, be positioned such that its lower edge is substantially parallel to the roadway surface 22. This parallel relationship is necessary for optimum scooping action by the feeder assembly 28, to be discussed in greater detail hereafter.

As more clearly shown in FIG. 2, the first parallelogram linkage 122 has parallel first and second cross members 124 and 126, and a diagonal member 128, all of which are pivotally connected at opposite ends to the first right-hand vertical member 116 and the second right-hand vertical member 120 via the pivot points 130, 132, 134 and 136 as shown in FIG. 2. The first cross member 124 is similar in construction to the upper connecting assembly 74 of the first forward connecting assembly 56, and is thus adjustable in length. By appropriate adjustment of the length of the first cross member 124, the rotational axis 110 of the first forward brush 104 may be disposed in a substantially vertical orientation for any given position of the forward subframe positioning assembly 54. As will be pointed out below, the first forward brush 104 is actually tilted slightly so that the rotational axis 110 is tilted somewhat from vertical, but the words "substantially vertical" will be used herein to mean a vertical as well as a near-vertical axial disposition thus encompassing a tilted, but near-erect brush assembly.

The diagonal member 128 is characterized by a dual telescoping cylinder construction and functions as a first forward vertical limiting apparatus. The diagonal member 128 consists of an inner cylinder 129 and an outer cylinder 131. One end of the inner cylinder 129 is pivotally connected to the first right hand vertical member 116 and the second cross member 126 at pivot point 134; and one end of the outer cylinder 131 is pivotally connected to the second right hand vertical member 120 and the first cross member 124 at pivot point 132 such that the outer cylinder 131 is slideably disposed over the inner cylinder 129. The inner cylinder 129 is also provided with an adjustable stop member (not shown) at a selected location thereon. Thus, the first parallelogram linkage 122 may be temporarily raised by the outer cylinder 131 sliding over the inner cylinder 129 when the first forward brush assembly 100 encounters an obstruction or irregularity on the roadway surface 22. After such an obstruction is passed, the first parallelogram linkage 122 will lower until the outer cylinder 131 engages the stop member (not shown) on the inner cylinder 129, and the first forward brush assembly 100 assumes its limiting position in contact with the roadway surface 22. The vertical height above the roadway surface 22 of this limiting position may be varied by altering the location of the stop member (not shown) on the inner cylinder 129. If fixing the first forward brush assembly 100 in a raised position above the roadway surface 22 is required, as for shipment of the front-end loader apparatus 10, the first parallelogram linkage 122 may be raised until an aperture (not shown) in the outer cylinder 131 overlays an aperture (also not shown) in the inner cylinder 129, and the first parallelogram linkage 122 may then be secured via a pin placed through the overlaying apertures.

As is known, a gutter type brush must be tilted somewhat so that only a portion of the sweeping end of the brush engages the surface being swept. Otherwise, contacted debris would simply be slung away from the brush in a nonuseful manner. By tilting the brush to lift one side of the brush from the pavement, the contacted debris will be motivated in a desired direction. In the present invention, side 138 of the first forward brush 104 (FIG. 3) is engaged in sweeping contact with the roadway surface 22 by tilting the first forward brush 104, while side 140 of the first forward brush 104 is elevated somewhat from the roadway surface 22. This is achieved by the pivoting connection provided between the platform member 108 of the first forward brush assembly 100 and the second right-hand vertical member 120 of the first forward linkage assembly 114 (FIG. 2). A pair of axially aligned apertures (not shown) are provided in the platform member 108 and in the second right-hand vertical member 120, and bolt member 142 is positioned to pass through these aligned apertures. In like manner, another bolt member 144 passes through an aperture in the second right-hand vertical member 120 and through a curved slot (not shown) in the platform member 108. When the bolt members 142 and 144 are loosened, the platform member 108 can be placed in a selected angular disposition (within limitations of the curved slot) relative to the second right-hand vertical member 120, thus providing for the selective tilting of the rotational axis 110 of the first forward brush 104. Once the desired degree of tilt of the first forward brush 104 is established, the first forward brush 104 is maintained in the desired position by tightening the bolts members 142 and 144.

Referring to FIGS. 1 and 3, the second forward brush assembly 102 (which is substantially identical in construction as the first forward brush assembly 100 is described hereinbefore) comprises a second forward brush 146 disposed to rotate about a substantially vertical rotational axis. The second forward brush 146 is connected to the second side member 50 of the brush-supporting forward subframe 46 via a second forward linkage assembly 148. The second forward linkage assembly 148 (which is substantially identical in construction as the first forward linkage assembly 114) comprises a first left-hand vertical member, a second left-hand vertical member, a second parallelogram linkage, and a second vertical limiting apparatus. Because the components of the second forward brush assembly 102 are identical to those of the previously described first forward brush assembly 100, and are arranged identically, the construction of the second forward brush assembly 102 will not be described in further detail. However, it will be noted that the second forward brush 146 of the second forward brush assembly 102 is tilted so that it is elevated somewhat above the roadway surface 22 on its side 150 and is in contact with the roadway surface on its side 151. The second forward brush 146 will rotate in a clockwise direction, as shown by the arrow 152 in FIGS. 1 and 3.

Referring now to FIG. 2, a first forward brush pivoting assembly 154 is provided to position the first forward brush assembly 100 in a selected angular disposition relative to the brush-supporting forward subframe 46. The first forward brush pivoting assembly 154 comprises a biasing first shock absorber 156 and a first hydraulic cylinder 158 that are connected as follows. The first shock absorber 156 is pivotally connected at one of its ends to a lug 160 that extends from the first right-hand vertical member 116 of the first forward linkage assembly 114; and the other end of the first shock absorber 156 is pivotally connected to a lug 162A that is pivotally connected to the brush-supporting forward subframe 46. One end of the first hydraulic cylinder 158 is pivotally connected to the brush-supporting forward subframe 46 via a lug 162B; and the other end of the first hydraulic cylinder 158 is pivotally connected to the brush-supporting forward subframe 46 via a lug 164. The lugs 162A and 162B are restricted to common pivotation by passing a common arbor (not shown) through the apertured clevis ends of the first shock absorber 156 and the first hydraulic cylinder 158.

The above arrangement of the first forward brush pivoting assembly 154 serves to position the first forward brush assembly 100 by the selective extension of the first hydraulic cylinder 158, while the first shock absorber 156 permits momentary deflection and return of the first forward brush assembly 100 should the first forward brush 104 strike a large object during its operation.

As shown in FIGS. 1 and 3, a second forward brush pivoting assembly 166 positions the second forward brush assembly 102 in a manner identical to the positioning action of the first forward brush assembly 100 by the just-described first forward brush pivoting assembly 154. Referring more specifically to FIG. 3, the second forward brush pivoting assembly 166 comprises a second shock absorber 168 and a second hydraulic cylinder 170. The second shock absorber 168 is connected to the brush-supporting forward subframe 46 and the second forward linkage assembly 148 in a manner similar to the first shock absorber 156; and the second hydraulic cylinder 170 is connected to the brush-supporting forward subframe 46 in a manner similar to the first hydraulic cylinder 158 as described hereinbefore. Because the first and second forward brush pivoting assemblies 154 and 166 feature identically arranged components, the construction of the second forward brush pivoting assembly 166 will not be described in further detail.

As depicted in FIG. 3, the brush-supporting forward subframe 46 further comprises a pair of scoop members 172 and 174. The scoop members 172, 174 (which serve as forward extensions of the brush-supporting forward subframe 46) are pivotally connected to the first and second side members 48, 50, respectively of the brush-supporting forward subframe 46 via pivot connectors 176, 176A. The scoop members 172 and 174 are further characterized as having a lug portion 178, 178A respectively extending therefrom.

The first side member 48 and the second side member 50 of the brush-supporting forward subframe 46 are provided with lugs 184, 184A, respectively extending outwardly therefrom substantially as shown in FIG. 3. An extension member 180 pivotally connects the lug portion 178 of the scoop member 172 to the first side member 48 of the brush-supporting forward subframe 46 via the lug 184. Similarly, an extension member 182 pivotally connects the lug portion 178A of the scoop member 174 to the second side member 50 of the brush-supporting forward subframe 46 via the lug 184A. The two extension members 180 and 182 position the scoop members 172 and 174 as required to collect particulate material into the feeder cavity 92 as the front-end loader apparatus 10 is motivated in the forward direction 16.

Since the extension members 180 and 182 are identical in construction, only the extension member 180 will be described in detail. The extension member 180 comprises a cylindrically shaped sleeve portion 186 and a rod portion 188. One end of the rod portion 188 of the extension member 180 is pivotally connected to the lug 184 of the first side 48 of the brush-supporting forward subframe 46; and one end of the cylindrically shaped sleeve portion 186 of the extension member 180 is pivotally connected to the lug portion 178 of the scoop member 172 such that the cylindrical shaped sleeve portion 186 slideably receives a portion of the rod portion 188 therein. A series of holes (not shown) are provided in the rod portion 188 of the extension member 180 and an aperture (not shown) is provided in the sleeve portion 186 of the extension member 180. Thus, by positioning a bolt 190 through the aperture (not shown) in the sleeve portion 186 and through an aligned selected hole (not shown) in the rod portion 188 of the extension member 180, the length of the extension member 180 can be varied so as to establish the desired angular disposition of the scoop member 172.

As previously stated, the material transport assembly 26 of the front-end loader apparatus 10 comprises the feeder assembly 28 and the elevator assembly 30. The feeder assembly 28 scoops up substantially all of the coarse material in the window, as well as a portion of the fine material therein, as the front end loader 10 is motivated in the direction 16. As shown in FIGS. 1 and 3, the feeder assembly 28 comprises a material pusher assembly, such as a motorized paddle wheel 192, and a scraper blade 202 (see FIG. 2). The motorized paddle wheel 192 is supported by a frame assembly 194. The frame assembly 194 is supported by the brush-supporting forward subframe 46 via lug support members (not shown). Conventional bracing is provided to support the paddle wheel 192 in the feeder cavity 92, and a conventional motor and chain drive (not shown) are provided on the frame assembly 194 to motivate the paddle wheel 192 to rotate about supporting sprockets in the direction shown by the arrown 196.

The paddle wheel 192 comprises a rotatable wheel drum 198 that supports a plurality of radially extending paddles or slats 200 which engage particulate material in the feeder cavity 92 to push the material rearward and onto the roadway scraper blade 202. The scraper blade 202, shown in FIG. 2 is supported by the brush-supporting forward subframe 46 as a component part of the material transport assembly 26. The scraper blade 202 cooperates with the paddle wheel 192 to direct the scooped particulate material onto the elevator assembly 30 for delivery of the particulate material towards the rearward end 40 of the main frame 36.

As best shown in FIGS. 1 and 2, an additional element of the material transport assembly 26 is the elevator assembly 30. The elevator assembly includes a material lifting conveyor 204. The material lifting conveyor 204 comprises an endless conveyor belt 205 mounted on conventional supporting rollers on a frame assembly 206 supported by the main frame 36. The material lifting conveyor 204 has a discharge (or first) end 32 and a receiving (or second) end 208. The receiving end 208 of the material lifting conveyor 204 is pivotally attached, via conventional support structure (not shown), beneath the forward end 38 of the main frame 36 so that the receiving end 208 is disposed in close proximity to the brush-supporting forward subframe 46 and the feeder assembly 28. The receiving end 208 of the material lifting conveyor 204 is formed so that the conveyor belt 205 receives particulate material pushed from the upper end of the roadway scraper blade 202 by the action of the motorized paddle wheel 192. A conventional hydraulic motor causes the conveyor belt 205 to rotate about the rollers in the direction shown by the arrow 212, thus permitting transfer of particulate matter deposited on the belt to the discharge end 32 of the material lifting conveyor 204.

The elevator assembly 30 further comprises a support placement assembly 214 which permits selective movement of the material lifting conveyor 204 between a first (or raised) mode and a second (or lowered) mode. In the first mode (shown in solid lines in FIG. 2) the discharge end 32 of the material lifting conveyor 204 is elevated; and in the second mode (shown in dashed lines in FIG. 2) the discharge end 32 of the material lifting conveyor 204 is lowered. As shown in FIGS. 1 and 2, the support placement assembly 214 comprises a folding stabilizer assembly 216. The support placement assembly prevents twisting and side-to-side movement of the material lifting conveyor 204. The support placement assembly 214 includes an upper cross frame 218 and a lower cross frame 220. The upper cross frame 218 comprises a pair of parallel side members, such as side member 219. The parallel side members of the upper cross frame 218 are pivotally connected at one end thereof to the sides of the material lifting conveyor 204; and the other ends of the parallel side members are interconnected by a cross brace 224.

The lower cross frame 220 also comprises a pair of parallel side members, such as side member 221. The parallel side members of the lower cross frame 220 are pivotally attached at one end thereof to the main frame 36 and the opposed end of each of the parallel side members of the lower cross frame 220 is pivotally attached to the other end of one of the side members of the upper cross frame 218. A cross brace (not shown) interconnects the side members of the lower cross frame 220.

The support placement assembly 214 further comprises a pair of hydraulic cylinders, such as hydraulic cylinder 222. The hydraulic cylinders are disposed on each side of the material lifting conveyor 204 such that upon activation of the hydraulic cylinders the material lifting conveyor 204 is moved between the first mode (raised position) and the second mode (lowered position). Each hydraulic cylinder, such as hydraulic cylinder 222, is pivotally attached at its base to the main frame 36, while the piston rod carried by each hydraulic cylinder is pivotally attached to the material lifting conveyor 204. The hydraulic cylinders are connected in parallel to a conventional hydraulic power source (not shown) so that the piston rods may be extended or retracted as required to position the material lifting conveyor 204 in the first mode or in the second mode.

When the material lifting conveyor 204 is in the second mode, the discharge end 32 of the material lifting conveyor 204 is lowered to substantially the same height as the top of the cab unit 44 of the front-end loader apparatus 10. This configuration is most suitable when the front-end loader apparatus 10 is non-operational and is to be transported for substantial distances on, for example, a flatbed trailer, when height restrictions in underpasses and tunnels require a minimum height for the front-end loader apparatus 10. When the front-end loader apparatus 10 is being operated, the material lifting conveyor 204 is disposed in the first mode (e.g. the material lifting conveyor 204 is elevated to the position depicted in FIG. 1 and by solid lines in FIG.2). When the material lifting conveyor 204 is positioned in the first mode, particulate material carried by the conveyor belt 205 of the material lifting conveyor 204 may fall from the discharge end 32 of the material lifting conveyor 204 into a waiting receptacle, such as a truck.

Referring to FIGS. 1 and 2, the residual material cleaning assembly 34 further comprises a brush-supporting rear subframe 234 having a vertically extending right side member 238 and the left side member (not shown). The right side member 238 and the left side member (not shown) are generally parallel to each other and are rigidly interconnected via a second cross beam member 236. The vertically extending right and left side members are identical in construction. Thus, only the right side member 238 will be described in detail. The right side member 238 is pivotally connected to the frame assembly 12 via a first rear connecting assembly 240. The frame assembly 12 has a pair of rear support members 242 (only one being depicted) which are attached to the underside of the main frame 36. The first rear connecting assembly 240 comprises a pair of connecting members 244, each of which is pivotally connected at one end to the right side member 238 and at an opposite end of the rear support member 242. In a like member, a second rear connecting assembly (not shown) comprising a pair of connecting members (not shown) which are pivotally connected to the left side member (not shown) and another support member (not shown).

The brush-supporting rear subframe 234 is further provided with a rear subframe positioning assembly 246. The rear subframe positioning assembly 246 comprises a first hydraulic cylinder 248 and a second hydraulic cylinder (not shown). The first hydraulic cylinder 248 is pivotally connected via its piston rod to the right side member 238 of the brush-supporting rear subframe 234; and the other end of the hydraulic cylinder 248 is connected to the main frame 36. In like manner, the second hydraulic cylinder (not shown) of the rear subframe positioning assembly 246 is pivotally connected to the second left side member (not shown) and the main frame 36 on the opposite side of the frame assembly 12. The hydraulic conduits and pressure fluid source which operate the hydraulic cylinders in parallel are conventional and are not shown; it is sufficient to note that the extension or retraction of the piston rods serve to position the brush-supporting rear subframe 234 alternately in an extended mode in which the brush-supporting rear subframe 234 assumes the roadway sweeping position depicted in FIGS. 1 and 2, or in a retracted mode in which the brush-supporting rear subframe 234 is raised.

Referring now to FIG. 2, the residual material cleaning assembly 34 of the front-end loader apparatus 10 further comprises a flexible ground scoop 288, a transverse brush assembly 280, and a residual material conveying assembly 285. The flexible ground scoop 288, which will be described in detail hereinafter, is supported beneath the brush-supporting rear subframe 234 so that the ground scoop 288 is in sliding contact with the roadway surface, and yet, at the same time, allow residual particulate material to pass therebeneath. The transverse brush assembly 280, which will also be described in detail hereinafter, is supported beneath the brushsupporting rear subframe 234 a distance rearward of the ground scoop 288, the transverse brush assembly 280 sweeping the residual particulate material on the roadway surface in a forward direction and onto the ground scoop 288. The residual material conveying assembly 285 is mounted on the frame assembly of the front-end loader apparatus 10 such that the residual material conveying assembly 285 receives the particulate material from the ground scoop 288 and carries such particulate material to the conveyor belt 205 of the material lifting conveyor 204. The residual material conveying assembly 285 will be described in more detail hereinafter.

Figure 4:
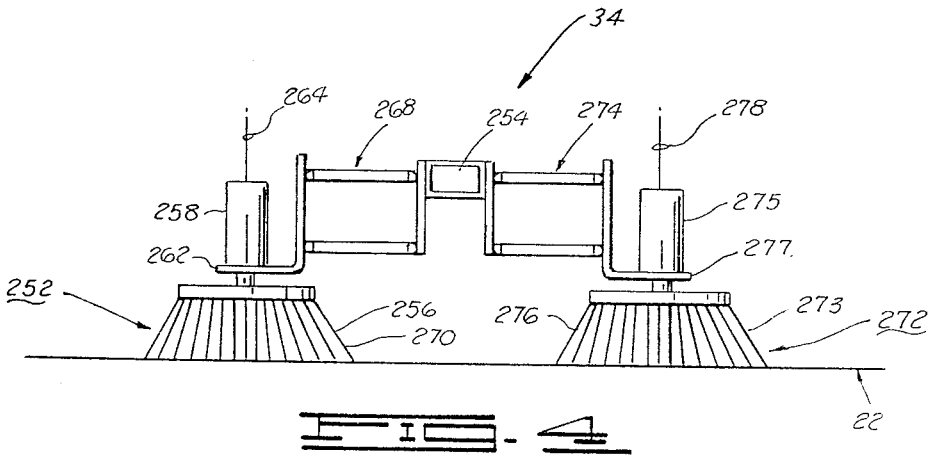
FIG. 4 is a partially detailed schematic view taken along line 4—4 in FIG. 2, showing the linkage assemblies connecting the first and second rear brush assemblies to the rear beam member.

As best shown in FIGS. 2 and 4, the residual material cleaning assembly 34 further comprises a first rear brush assembly 252 which is supported by a rear beam member 254. The rear beam member 254 is disposed intermediate to the right side member 238 and the left side member (not shown), and extends horizontally towards the forward end 38 of the front-end loader apparatus 10. The first rear brush assembly 252 comprises a first or right rear brush 256 of the gutter type and a hydraulic motor 258 connected to a brush shaft. The hydraulic motor 258, supported by a platform member 262, is operable via high pressure hydraulic fluid (supplied by conduits not shown) to rotate the first rear brush 256 about a substantially vertical rotational axis 264 in the same rotational direction as the first forward brush 104, as shown by the arrow 266 (see FIG. 1).

As best shown in the schematic representation of FIG. 4, the residual material cleaning assembly 34 further comprises a first rear linkage assembly 268 for connecting the first rear brush assembly 252 to the rear beam member 254. The first rear linkage assembly 268 has a parallelogram configuration similar to the first forward linkage assembly 114 as hereinbefore described. The parallelogram construction of the first rear linkage assembly 268 permits the first rear brush 256 to be raised and lowered in response to irregularities in the roadway surface 22 while the brush shaft carrying the first rear brush 256 maintains a substantially constant vertical orientation toward the roadway surface. Like the forward brushes 104, 146 of the window formation assembly 24, the first rear brush 256 is selectively maintained in tilted contact with the roadway surface 22 on the side 270, for optimum sweeping action. A vertical limiting apparatus (not shown), similar in construction to the diagonal member 128 of the first parallelogram linkage 122 of the first forward linkage assembly 114, may be provided for the first rear linkage assembly 268 so that the linkage returns the first rear brush 256 to a predetermined height above the roadway surface 22 after the first rear brush 256 is temporarily raised by an obstruction.

Further comprising the residual material cleaning assembly 34, as depicted in FIG. 4, is a second rear brush assembly 272 supported by the rear beam member 254 and comprising a second rear brush 273 and a hydraulic motor 275 supported on a platform member 277. The second rear brush assembly 272 is disposed adjacent to the left side member (not shown) and is connected to the rear beam member 254 via a second rear linkage assembly 274. The second rear brush assembly 272 is oriented in tilted contact with the roadway surface 22 at side 276 and rotates around the substantially vertical rotational axis 278 in the same rotational direction as the second forward brush 146 of the window formation assembly 24. Because the components of the second rear brush assembly 272 are identical in design and arrangement to those of the first rear brush assembly 252 previously described, the second rear brush assembly 272 will not be described in further detail.

Disposed on the opposite side of the second cross beam member 236 from the first and second rear brush assemblies 252 and 272 is the transverse brush assembly 280. The transverse brush assembly 280 comprises a drumtype transverse brush 282 mounted on a substantially horizontal brush shaft (not shown) having an axis transverse to the longitudinal axis of the front-end loader apparatus 10. A conventional hydraulic motor assembly 284, connected to the brush shaft, effects counterclockwise rotation of the transverse brush 282 in the direction shown by the arrow 286. Support beams 287 serve to connect the transverse brush assembly 280 to the second cross beam member 236.

As previously indicated, the residual material conveying assembly 285 of the residual cleaning assembly 34 receives particulate material collected by the transverse and rear brush assemblies and transports such material to the elevator assembly 30. The residual material conveying assembly 285 comprises a first trough member 290 suspended from the second cross beam member 236 of the brush-supporting rear subframe 234 such that the first trough member 290 extends between the right side member 238 and the left side member (not shown) of the brush-supporting rear subframe 234. The first trough member 290 has a side opening adjacent to and along the length of the transverse brush assembly 280, so that particulate material swept from the roadway surface 22 by the turning action of the transverse brush 282 may enter the side opening and be retained in the lower portion of the first trough member.

The flexible ground scoop 288, comprising a substantially planar member formed from rubber or a similar flexible material, is suspended from the first trough member 290 of the residual material conveying assembly 285 so that the ground scoop 288 is positioned immediately below the side opening of the first trough member 290 and extends in close proximity to the roadway surface 22. The ground scoop 288 is also in close proximity, and in substantially tangential relation, to the cylindrical surface of the transverse brush 282 near the first trough member. Thus, particulate material collected beneath the main frame 36 by the first and second rear brush assemblies 252 and 272 is passed beneath the ground scoop 288 because of the flexing action of the ground scoop 288, and this particulate material is thereafter swept forward by the rotating transverse brush 282 over the ground scoop 288 into the opening of the first trough member 290 of the residual material conveying assembly 285. The ground scoop 288 thus restricts the forward movement of the swept material and guides the swept material into the side opening of the first trough member 290. Lifted particulate material not entering the side opening of the first trough member 290 drops onto the roadway surface 22 between the ground scoop 288 and the transverse brush assembly 280, where it may undergo one or more further lifting cycles until finally arriving in the first trough member 290 of the residual material conveying assembly 285.

Located within the first trough member 290 of the residual material conveying assembly 285 is a first auger assembly 291 (depicted in dashed lines in FIG. 2). The first auger assembly 291 is mounted on a horizontal shaft and disposed parallel to the longitudinal axis of the first trough member 290. The horizontal shaft is supported at either end by conventional bearings on the right side member 238 and the left side member (not shown) of the brush-supporting rear subframe 234. The horizontal shaft is powered by a conventional hydraulic motor assembly discussed below. When the first auger assembly 291 is rotated on its horizontal shaft by the hydraulic motor assembly, particulate material collected in the first trough member 290 of the residual material conveying assembly 285 is moved through the first trough member 290 towards the right side member 238 of the brush-supporting rear subframe 234. The particulate material is carried through an opening in the right side member 238 of the brush-supporting rear subframe 234 to a residual material lifting conveyor 292.

The residual material lifting conveyor 292 of the residual conveying assembly 285 comprises a motorized slat conveyor 293 supported by a frame assembly 294. The frame assembly 294 is attached to the right side member 238 of the brush-supporting rear subframe 234. The slat conveyor 293, which comprises an endless chain carrying a plurality of slats, is mounted on conventional sprockets at its first end 296 and second end 298. A conventional hydraulic motor assembly (not shown) causes the sprockets to rotate in the counterclockwise direction as indicated by the arrow 300, thus moving the chain so that the slats will carry particulate material delivered by the first auger assembly 291 to the second end 298 of the residual material lifting conveyor 292. The sprocket disposed at the first end 296 of the residual material lifting conveyor 292 shares a common shaft with the first auger assembly 291. The residual material exits the residual material lifting conveyor 292 via the second end 29 and is directed into a receiving hopper 304 carried by the main frame 36 of the front-end loader apparatus 10. Located in the lower portion of the receiving hopper 304 is a bottom chute 306 (shown in dashed lines in FIG. 2) which permits particulate material in the receiving hopper 304 to fall onto the conveyor belt 205 of the material lifting conveyor 204.

A water tank 308 is carried on the main frame 36 and is connected by conventional conduits to a plurality of spray nozzles (not shown), which are disposed adjacent to the first and second forward brush assemblies 100 and 102, the first and second rear brush assemblies 252 and 272, and the transverse brush assembly 280. Water spray may be selectively motivated, via conventional pump and valve means, as required to reduce atmospheric dust levels in the areas near the brush assemblies.

Additional collecting action for fine particulate material may be provided by augmenting the residual material cleaning assembly 34 with one or more suction nozzles 310 disposed behind and adjacent to the transverse brush assembly 280. When connected to a conventional suction-type pump, each suction nozzle will draw in, by vacuum action, fine particulate material not collected by the transverse brush assembly 280. If desired, the fine particulate material drawn up by the suction nozzles may be collected on filters or the like and conveyed directly or indirectly to the material lifting conveyor 204 for disposition with other particulate material collected by the apparatus 10.

In preparation for operation of the front-end loader apparatus 10, the material lifting conveyor 204 is disposed in its first mode by the support placement assembly 214. In further preparation, the forwad subframe positioning assembly 54 and the rear subframe positioning assembly 246 are actuated to engage the windrow formation assembly 24, the rear brush assemblies 252 and 272, and the transverse brush assembly 280 in their extended modes, with their brushes in contact with the roadway surface 22. These component movements, as well as most others require for the operation of the front-end loader apparatus 10, may be accomplished via conventional control assemblies disposed in the cab unit 44.

Prior to the operation of the apparatus 10 the extension members 180 and 182 are manually adjusted so that the scoop members 172 and 174 are situated at an optimal angular disposition for collecting the windrow of material to be loaded. Similarly, the forward brush pivoting assemblies 154 and 166 are adjusted so that the first forward brush assembly 100 and second forward brush assembly 102 are spaced at a distance adequate to sweep unwindrowed particulate material on the roadway surface 22 into a pre-existing windrow of material formed by a planing apparatus. In the event that zones of scattered material of differing widths are encountered as the apparatus 10 is in operation, the extension of the first hydraulic cylinder 158, and its counterpart cylinder on the opposite side of the apparatus 10, may be altered in order to change the spacing of the forward brush assemblies 100 and 102.

In operation, the front-end loader apparatus 10 is moved by the drive assembly 14 in the forward direction 16 along a collection path 20 on the roadway surface 22. The collection path 20 will be selected to minimize the distance which particulate material must be moved in order to be received in the feeder cavity 92. Thus, if a windrow of material has been left by a planer apparatus, the collection path 20 will preferably substantially coincide with the pre-existing windrow. The sweeping action of the forward brush assemblies 100 and 102, which are maintained in contact with the roadway surface 22 by the first forward linkage assembly 114 and the second forward linkage assembly 148 causes particulate material on the roadway surface 22 to collect in a windrowed form. The parallelogram configuration of the forward linkage assemblies 114 and 148 permits the forward brushes 104 and 146 to move around obstructions and irregularities encountered in the roadway surface 22, while maintaining a tilted orientation for optimum sweeping action.

It will be noted that the apparatus 10 provides an extensive degree of operational flexibility in the disposition of the forward brushes 104 and 146, as is required for roads under construction or repair. Because of the mobility of the brushes, cumbersome maneuvering of a frame assembly is generally not required to collect scattered particulate material, as has been the case in prior art apparatus. Instead, as discussed previously, the forward brush pivoting assemblies permit collection of outlying particulate material by movement of the forward brushes alone.

In addition to having horizontal mobility, the forward brushes 104, 146 are vertically mobile as well. The brush-supporting forward subframe 46, and the forward brush assemblies 100 and 102 carried thereby, can be raised or lowered to a height above or below that of the road-contacting portions of the wheels 42, as might be required, for example, to collect material disposed on an elevated or depressed surface between the wheels 42. This raising or lowering action is accomplished by the forward subframe positioning assembly 54, in conjunction with the horizontal subframe adjustment apparatus of the forward connecting assemblies 56 and 82.

Further flexibility in forward brush placement is provided by the diagonal members provided in the first and second forward linkage assemblies 114 and 148, such as the diagonal member 128 of the first forward linkage assembly 148. By raising the stop member on the inner cylinder of one of the diagonal members, such as the inner cylinder 129 of the diagonal member 128, one forward linkage assembly may be disposed to hold its corresponding forward brush at a different height above the roadway surface than that of the other forward brush. This configuration could be required in the event that particulate material is disposed in part on an elevated curb surface to one side of the frame assembly 12.

As the apparatus 10 moves forward along the collection path 20, the coarse particles in the windrow formed by the windrow formation assembly 24 will be directed by the scoop members 172 and 174 and the roadway scraper blade 202 into the central feeder cavity 92. The particles in the central feeder cavity 92 will be moved rearwardly by the paddle wheel 192, over the roadway scraper blade 202, and onto the conveyor belt 205 via the receiving end 208 of the material lifting conveyor 204. The particulate material will be carried by the conveyor belt 205 to the discharge end 32 of the material lifting conveyor 204 where it will be dropped into a waiting truck. Fine particulate material not collected by the feeder assembly 28 is formed into a residual windrow by the action of the first and second near brush assemblies 252 and 272, which operate in a manner substantially identical to that of the first and second forward brush assemblies 100 and 102 already described. As the apparatus 10 moves in the forward direction 16, the flexible ground scoop 288 passes over the residual windrow and the windrow material is thereafter swept forward by the rotating transverse brush 282, over the ground scoop 288, and into the first trough 290 of the residual material conveying assembly 285. Material not entering the first trough 290 will fall between the ground scoop 288 and the transverse brush assembly 280, and will thereafter be swept forward again as the front end loader apparatus 10 moves forward. This cycle will be repeated until the material reaches the first trough 290 of the residual material conveying assembly 285.

The first auger assembly 291 of the residual material conveying assembly 285 carries particulate material from the first trough 290 to the residual material lifting conveyor 292 where the slat conveyor 293 lifts the material to the second end 298 of the residual material lifting conveyor 292 from which the material falls into the receiving hopper 304. From the receiving hopper 304 the fine particulate material is thereafter transferred to the material lifting conveyor 204 via the bottom chute 306. Fine particulate material received on the material lifting conveyor 204, like the large particulate material discussed previously, is thereafter discharged at the rear of the front-end loader apparatus 10 into a waiting truck.

When the front-end loader apparatus 10 is not in use, the material lifting conveyor 204 may be lowered into its second mode, in which it is disposed at a height substantially equal to that of the cab unit 44. With the material lifting conveyor 204 in its second mode, and with the forward, rear and transverse brush assemblies in their retracted, off-the-ground modes, the front-end loader apparatus 10 may be moved onto a flatbed trailer and transported by highway.

DESCRIPTION OF FIG. 5

Figure 5:
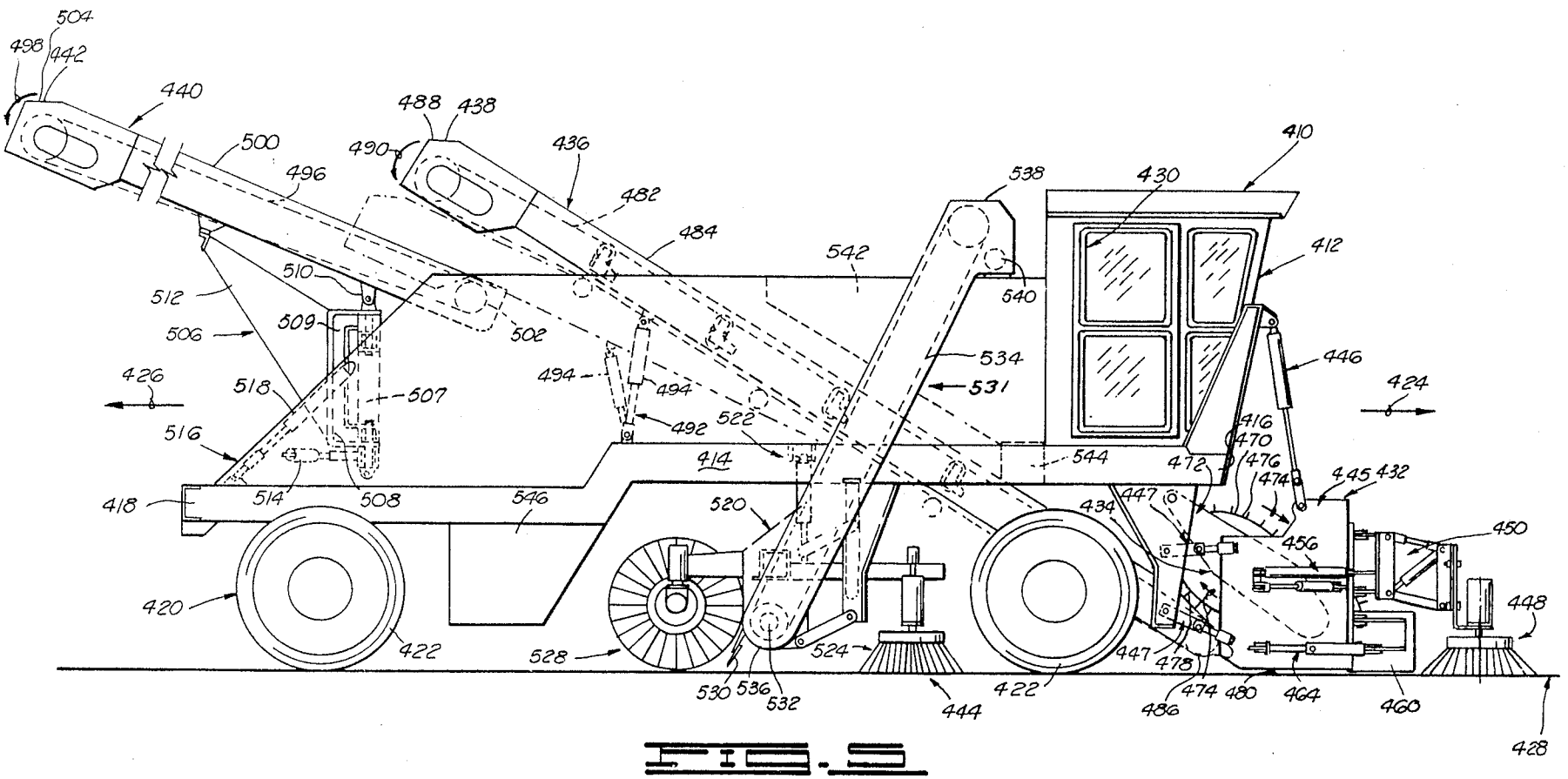
FIG. 5 is a side elevational view of another embodiment of the front-end loader apparatus of the present invention.

With continued reference to the drawings, and particularly with reference to FIG. 5, shown therein and designated by the reference numeral 410 is another embodiment of the front-end loader apparatus constructed in accordance with the present invention. While a detailed description will be provided hereinbelow, a general description of the components that comprise the front-end loader apparatus 410 may assist in an understanding of its construction.

The front-end loader apparatus 410 comprises a frame assembly 412 having a main frame 414. The main frame 414 is provided with a forward end 416 and a rearward end 418. The main frame 414 is supported by a drive assembly 420, part of which is represented by wheels 422 that support the main frame 414 via conventional axle and connector mechanisms. A conventional power plant, such as a diesel engine, and conventional hydraulic pump and transmission means are provided for moving the frame assembly 412 in a forward direction 424 and in a rearward direction 426 along a roadway surface 428. The frame assembly 412 has a cab unit 430 and conventional operator controls disposed therein (not shown) to enable an operator to selectively drive the frame assembly 412 via the drive assembly 420 along the roadway surface 428 for the purpose of collecting particulate material disposed therealong.

A windrow brush assembly 432, substantially identical to the windrow formation assembly 24 of the first embodiment of the present invention, is supported at the forward end 416 of the main frame 414 in a manner such that components thereof sweepingly engage the roadway surface 428 for brushing particulate material into a windrowed pile as the frame assembly 412 is driven forward.

A feeder assembly 434 is supported at the forward end 416 of the main frame 414 and functions to scoop up the material windrowed by the windrow brush assembly 432 and to move the scooped material rearwardly. A first elevator assembly 436 is supported by the frame assembly 412 in a position to receive material from the feeder assembly 434 and to move the material to a first overhead discharge position 438 near the rearward end 418 of the main frame 414 where the elevated material is dropped onto a second elevator assembly 440, also supported by the frame assembly 412, for movement of the material to a second overhead discharge position 442 from where the material is dropped into a waiting truck (not shown).

A residual material cleaning assembly 444, supported beneath the frame assembly 412, functions to clean up fines and other material left by the feeder assembly 434. The residual material cleaning assembly 444 conveys the picked-up material to a residual discharge point above the first elevator assembly 436 from which point the material can be selectively dropped onto the first elevator assembly 436.

As will become clear with the description that follows, the front-end loader 410 functions in a substantially similar manner to the first embodiment of the front-end loader apparatus 10 of the present invention. Thus, the front-end loader 410 has the capability, via the windrow brush assembly 432 and the feeder assembly 434, of windrowing and picking up the bulk of scattered particulate material encountered as the front-end loader 410 is driven in the forward direction 424. Further, fine material that is left by the feeder assembly 434 is cleaned up by the residual material cleaning assembly 444. Material from both or either of the feeder assembly 434 and the residual material cleaning assembly 444 is carried to the rear of the frame assembly 412 by the cooperative efforts of the first elevator assembly 436 and the second elevator assembly 440, which place the elevated material in waiting trucks. A more detailed description of each of these component assemblies will now follow.

The windrow brush assembly 432, shown in FIG. 5 in semi-detail, schematic representation, comprises a brush-supporting forward subframe 445 connected to the main frame 414 and positionable via a forward subframe positioning assembly 446, a first forward connecting assembly 447, and a second forward connecting assembly (not shown). The brush-supporting forward subframe 445 comprises a first forward brush assembly 448 connected to the main frame 414 and positioned by a first linkage assembly 450, and a second forward brush assembly (not shown) connected to the main frame 414 and positioned by a second linkage assembly (also not shown). The first forward brush assembly 448 is movable in a horizontal plane via a first forward brush pivoting assembly 456, and the second forward brush assembly (not shown) is likewise movable via a second forward brush pivoting assembly (not shown). A first scoop member 460 and a second scoop member (not shown), selectively positionable via a first extension member 464 and a second extension member (not shown), define a central feeder cavity. Since the first forward brush assembly 448 is identical in construction to the second forward brush assembly, the first linkage assembly 450 is identical in construction to the second linkage assembly, and the first scoop member 460 is identical in construction to the second scoop member, and each of the above described components of the windrow brush assembly 432 are identical in construction and arrangement to the components of the windrow formation assembly 24 of the first embodiment of the present invention, the windrow brush assembly 432 will not be discussed in further detail, and reference is made to the previous discussion of the windrow formation assembly 24.

Turning now to the feeder assembly 434 and with continued reference to FIG. 5, the feeder assembly 434 comprises a material pusher means, such as a motorized slat conveyor 470. The motorized slat conveyor 470 is supported by a frame assembly 472 which is pivotally supported via lugs (not shown) extending from the underside of the forward end 416 of the main frame 414. Conventional bracing is provided to support the slat conveyor 470 in the feeder cavity (not shown) and a conventional hydraulic motor (not shown) is provided to motivate the slat conveyor 470 to rotate about supporting sprockets in the direction shown by the arrow 474.

The slat conveyor 470 comprises an endless chain belt 476 that supports a plurality of slats 478 which engage particulate material within the feeder cavity to push the material rearward and onto a roadway scraper blade 480. The roadway scraper blade 480 is supported by the brush-supporting forward subframe 445 as a component part of the windrow brush assembly 432. Thus, the roadway scraper blade 480 cooperates with the slat conveyor 470 to move the scooped particulate material in a rearward direction.

As shown in FIG. 5, the first elevator assembly 436 comprises a first material lifting conveyor 482. The first material lifting conveyor 482 comprises an endless conveyor belt mounted on conventional supporting rollers along a frame assembly 484 supported by the main frame 414. The first material lifting conveyor 482 has a first end 486 and a second end 488. The first end 486 of the first material lifting conveyor 482 is pivotally attached, via conventional support structure (not shown), beneath the forward end 416 of the main frame 414 so that the first end 486 of the first material lifting conveyor 482 is disposed in close proximity to the brush-supporting forward subframe 445 and the feeder assembly 434. The first end 486 of the first material lifting conveyor 482 is formed so that the conveyor belt may receive particulate material pushed from the upper end of the roadway scraper blade 480 by the action of the motorized slat conveyor 470 of the feeder assembly 434. A conventional hydraulic motor causes the conveyor belt of the first material lifting conveyor 482 to rotate about the rollers in the direction shown by the arrow 490, thus permitting transfer of particulate matter deposited on the belt.

The first elevator assembly 436 further comprises a first support placement assembly 492 which permits selective pivotal movement of the first material lifting conveyor 482 between a first mode and in a second mode. When the first material lifting conveyor 482 is in the first mode, the second end 488 of the conveyor is elevated to the position depicted in FIG. 5; whereas, when the material lifting conveyor 482 is in the second mode (shown in phantom lines in FIG. 5) the second end 488 of the first material lifting conveyor 482 is retracted. The first support placement assembly 492 comprises a pair of hydraulic cylinders, such as hydraulic cylinder 494. The hydraulic cylinders are disposed on each side of the first material lifting conveyor 482. Each hydraulic cylinder, such as the hydraulic cylinder 494, is pivotally attached at its base to the first material lifting conveyor 482, while the piston rod carried by each hydraulic cylinder is pivotally attached to the main frame 414. The hydraulic cylinders are connected in parallel to a conventional hydraulic power source (not shown) so that the piston rods may be extended or retracted as required to position the first material lifting conveyor 482 in the first mode or in the second mode.

When the first material lifting conveyor 482 is in the second mode, the second end 488 of the first material lifting conveyor 482 is lowered to substantially the same height as the top of the cab unit 430 of the front-end loader apparatus 410. This configuration is most suitable when the front-end loader apparatus 410 is non-operational and is to be transported for substantial distances on, for example, a flatbed trailer. When the front-end loader apparatus 410 is being operated, the first material lifting conveyor 482 is disposed in the first mode, and is elevated to the position depicted in FIG. 5. When the first material lifting conveyor 482 is positioned in the first mode, particulate material carried by the conveyor belt of the first material lifting conveyor 482 may fall, via a conventional discharge port, from the second end 488 of the first material lifting conveyor 482, which functions as a first overhead discharge position, to the second elevator assembly 440.

The second elevator assembly 440 comprises a second material lifting conveyor 496 which, like the first material lifting conveyor 482, comprises an endless belt conveyor mounted on conventional supporting rollers supported by a frame assembly 500. The endless belt conveyor of the second material lifting conveyor 496 rotates in a counterclockwise direction as indicated by the arrow 498. The second material lifting conveyor 496 has a first end 502 and a second end 504. The second material lifting conveyor 496 is pivotally connected to the main frame 414 of the front-end loader apparatus 410 via a support stand 506. The support stand 506 permits selective horizontal pivotal movement of the second material lifting conveyor 496 from one side of the front-end loader apparatus 410 to the other, as may be required to accommodate trucks receiving particulate material from the second material lifting conveyor 496.

The support stand 506 comprises a rigid frame member 507 pivotally mounted on the rearward end 418 of the main frame 414 of the front-end loader apparatus 410. The pivotal attachment of the rigid frame member 507 allows the rigid frame member 507 to rotate in a plane substantially perpendicular to the roadway surface 428 and substantially parallel to the longitudinal axis of the front-end loader apparatus 410. The rigid frame member 507 comprises a pair of parallel side members disposed on either side of the main frame 414 and connected by a pair of parallel horizontal members. Pivotally connected to the rigid frame member 507, at the horizontal members, is a conveyor support bracket 508. The pivotal attachment of the conveyor support bracket 508 allows the conveyor support bracket 508 to rotate in a plane perpendicular to that of the rigid frame member 507. Thus, the conveyor support bracket 508 is movable from one side of the main frame 414 of the front-end loader apparatus 410 to the other side.

The conveyor support bracket 508 includes a C-shaped bracket portion 509 which is connected via a brace 510 to the second material lifting conveyor 496, and a triangular support portion 512 which is connected to the C-shaped bracket portion 509 and engages the underside of the second material lifting conveyor 496 substantially as shown. The triangular support portion 512 of the conveyor support bracket 508 is not joined to the second material lifting conveyor 496 in order to permit greater flexibility of movement by the second material lifting conveyor 496 during loading of particulate material into trucks. A hydraulic cylinder 514, pivotally mounted on the main frame 414 of the front-end loader apparatus 410, is pivotally connected at its piston rod to the conveyor support bracket 508. By extending or retracting the piston rod of the hydraulic cylinder 514, the horizontal angular orientation of the support stand 506, with respect to the main frame 414 of the front-end loader apparatus 410, may be changed as required.

A second support placement assembly 516 permits the support stand 506 and the second material lifting conveyor 496 to move selectively between a first mode (shown in FIG. 5, in which the second material lifting conveyor 496 is elevated above the main frame 414 of the front-end loader apparatus 410, and disposed to receive and deliver particulate material) and a second mode (not shown in which the second material lifting conveyor 496 is lowered, as may be required for highway transport of the front-end loader apparatus 410). The second support placement assembly 516 preferably comprises a pair of hydraulic cylinders, such as hydraulic cylinder 518. The hydraulic cylinders are disposed on either side of the main frame 414 adjacent each side member of the rigid frame member 507. The piston rod of each hydraulic cylinder is pivotally mounted to the main frame 414 of the front-end loader apparatus 410 and the other end of each hydraulic cylinder is pivotally connected to its corresponding side member of the rigid frame member 507. When connected in parallel to a conventional source of hydraulic power (not shown) the hydraulic cylinders will move the second material lifting conveyor 496, which is connected to the rigid frame member 507, between the first mode, in which the piston rods are extended, and the second mode, in which the piston rods are retracted.

When the first material lifting conveyor 482 and the second material lifting conveyor 496 are both disposed in their first modes, the first end 502 of the second material lifting conveyor 496 is located directly below the second end 488 of the first material lifting conveyor 482, and is thus in a position to collect particulate material discharged from the second end 488 of the first material lifting conveyor 482. The first end 502 of the second material lifting conveyor 496 is constructed so that it may collect discharging particulate material regardless of the angular disposition of the second material lifting conveyor 496, as controlled by the support stand 506. Particulate material falling onto the first end 502 of the second material lifting conveyor 496 is carried by the conveyor to the second end 504, which functions as a second overhead discharge position and is appropriately constructed for unobstructed downward discharge of the material into waiting trucks.

The residual material cleaning assembly 444, shown in FIG. 5, comprises a brush-supporting rear subframe 520 disposable by a rear subframe positioning assembly 522. A first rear brush assembly 524, a second rear brush assembly (not shown), and a transverse brush assembly 528 are operably mounted on the brush-supporting rear subframe 520. The transverse brush assembly 528, in conjunction with a ground scoop 530, directs residual particulate material into a residual material conveying assembly 531. The residual material conveying assembly 531 comprises a first trough (not shown) having a first auger assembly 532 disposed therein to carry particulate material to a discharge point feeding a residual material lifting conveyor 534. The residual material lifting conveyor 534 is provided with a first end 536 and a second end 538. The above-described components of the residual material cleaning assembly 444 feature identical arrangement and construction to the corresponding components of the residual material cleaning assembly 34 of the front-end loader apparatus 10. Accordingly, the above-described components will not be discussed in further detail, and reference is made to the previous discussion relating to the first embodiment.

Particulate material is delivered from the second end 538 of the residual material lifting conveyor 534 to a horizontally extending second trough (not shown) disposed above and supported by the main frame 414 of the front-end loader apparatus 410. Located within the second trough is a second or overhead auger assembly 540 extending substantially parallel to the first auger assembly 532. The second auger assembly 540 is mounted on a horizontal shaft which is in turn supported by conventional bearing means on either end of the second trough. The second auger assembly 540 is powered via a conventional chain drive from the sprocket disposed at the second end 538 of the residual material lifting conveyor 534.

The second trough (not shown) is provided with an opening therein, the opening functioning as a residual material discharge point so that particulate material carried by the second auger assembly 540 falls downward through the opening in the second trough into a receiving hopper 542 which is carried by the main frame 414 of the front-end loader apparatus 410. Located in the lower portion of the receiving hopper 542 is a bottom chute 544 (shown in phantom lines) which permits particulate material in the receiving hopper 542 to fall onto the belt conveyor of the first material lifting conveyor 482.

A water tank 546 is carried on the main frame 414 of the front-end loader apparatus 410 for use with spray nozzles (not shown) in reducing atmospheric dust levels near the brush assemblies. The design of the tank, pumping mechanism and spray nozzles is identical to that featured in the first embodiment of the front-end loader apparatus 10, and will not be discussed in further detail.

In operation, the second embodiment of the apparatus 410 functions in a manner substantially similar to the front-end loader apparatus 10, which comprises the first embodiment of the present invention. The principal differences in operation of the two embodiments have already been presented in discussing the construction of the two embodiments. In particular, it will be noted that the apparatus 410 is characterized by the following operational features: a feeder assembly 434 comprising a slat conveyor 470 which loads particulate material from the roadway surface 28 onto the first elevator assembly 436; first and second material lifting conveyors 482 and 496, with the second material lifting conveyor 496 subject to horizontal rotation by the support stand 506, and the first and second material lifting conveyors 482 and 496 supported by first and second support placement assemblies 492 and 516 for selectively controlling the elevations of the respective conveyors; and a second auger assembly 540 for depositing particulate material carried by the residual material lifting conveyor 534 into the receiving hopper 542.

It is clear that the present invention is well adapted to carry out the objects and attain the ends and advantages mentioned as well as those inherent therein. While a presently preferred embodiment of the invention has been described for purposes of this disclosure, numerous changes may be made which will readily suggest themselves to those skilled in the art and which are encompassed within the spirit of the invention disclosed and as defined in the appended claims.

What is claimed is:

1. In a front-end loader apparatus for removing particulate material from a roadway, the apparatus including a frame assembly having a main frame with a forward end and a rear end, drive means for supporting and selectively driving the frame assembly over the roadway, and sweeping means for sweepingly engaging the roadway surface to remove particulate material therefrom, the sweeping means comprising:

windrow formation means supported at the forward end of the main frame for incorporating particulate material on the roadway into a windrow substantially coincident with the collection path;

material collecting means supported by the main frame for collecting substantially all of the windrowed particulate material, the material collecting means moving the collected particulate material in a rearward direction;

a first material lifting conveyor having a first end and a second end, the first end pivotally connected to the frame assembly in near proximity to the material collecting means;

support placement means for supporting and positioning the second end of the first material lifting conveyor in a first mode in which the second end is elevated, and for supporting and positioning the second end of the first material lifting conveyor in a second mode in which the second end is retracted.

a flexible ground scoop supported beneath the frame assembly in sliding contact with the roadway surface and disposed to allow residual particulate material to pass therebeneath;

transverse brush means supported beneath the frame assembly at a position rearward the ground scoop for sweeping the residual particulate material forward over the ground scoop; and residual material conveying means supported by the frame assembly for receiving the residual particulate material contacted by the transverse brush means, the residual material conveying means elevating the collected residual particulate material to a position over the first material lifting conveyor.

2. The sweeping means of claim 1 wherein the windrow formation means comprises:

a brush-supporting forward subframe connected to the forward end of the frame assembly; and parallel brush means supported by the brush-supporting forward subframe comprising a plurality of forward brush assemblies, each forward brush assembly having a brush rotatable about a substantially vertical axis and disposed in sweeping contact with the roadway, the forward brush assemblies supported in spaced-apart relationship for directing particulate material on the roadway into the windrow substantially coincident with the collection path.

3. The sweeping means of claim 2 wherein the brush-supporting forward subframe has a first side member and a second side member, and the parallel brush means further comprises:

a first brush assembly supported on the first side member of the brush-supporting forward subframe, and a second brush assembly supported on the second side member of the brush-supporting forward subframe, the first brush assembly and the second brush assembly having brushes operable in opposite relative rotational directions.

4. The sweeping means of claim 3 wherein the brush-supporting forward subframe is pivotally attached to the main frame, and the windrow formation means further comprises:

forward subframe positioning means for positioning the brush-supporting forward subframe between an extended mode in which the brushes of the first and second forward brush assemblies are positioned in contact with the roadway and a retracted mode in which the brushes of the first and second forward brush assemblies are positioned in clearing relationship to the roadway.

5. The sweeping means of claim 4 wherein the windrow formation means further comprises:

forward vertical positioning means connected to the brush-supporting forward subframe for selectively varying the height of the first and second forward brush assemblies above the roadway while maintaining the rotational axes of the brushes thereof in substantially vertically extending position.

6. The sweeping means of claim 5 wherein the forward vertical positioning means comprises:

a first right-hand vertical member connected to the first side member of the brush-supporting forward subframe;

a second right-hand vertical member connected to the first forward brush assembly; and a first parallelogram linkage disposed between and connecting the second right-hand vertical member to the first right-hand vertical member so that the rotational axis of the first forward brush is retained substantially vertical in the extended mode as the first forward brush is displaced vertically;

a first left-hand vertical member connected to the second side member of the brush-supporting forward subframe;

a second left-hand vertical member connected to the second forward brush assembly; and a second parallelogram linkage disposed between and connecting the second left-hand vertical member so that the rotational axis of the second forward brush is retained substantially vertical in the extended mode as the second forward brush is displaced vertically.

7. The sweeping means of claim 6 wherein the first vertical right-hand member is pivotally connected to the brush-supporting forward subframe for pivotation about a substantially vertical axis, the second vertical right-hand member is pivotally connected to the brush-supporting forward subframe for pivotation about a substantially vertical axis, and the windrow formation means further comprises:

first forward brush pivoting means for yieldingly positioning the first right-hand vertical member at a predetermined angular disposition, the first forward brush pivoting means permitting the first forward brush to be angularly displaced within a predetermined arc of displacement relative to the brush-supporting forward subframe; and second forward brush pivoting means for yieldingly positioning the first left-hand vertical member at a predetermined angular disposition, the second forward brush pivoting means permitting the second forward brush to be angularly displaced within a predetermined arc of displacement relative to the brush-supporting forward subframe.

8. The sweeping means of claim 3 wherein the windrow formation means further comprises:

a first scoop member connected to the first side member of the brush-supporting forward subframe; and a second scoop member connected to the second side member of the brush-supporting forward subframe, the first and second scoop members extending inwardly in a converging manner to define a feeder cavity, the first and second scoop members serving to direct particulate material through the feeder cavity for receipt by the material transport means.

9. The sweeping means of claim 8 in which the material transport means further comprises:

feeder means disposed near the feeder cavity and supported by the main frame for contacting windrowed particulate material and moving it in a rearward direction through the feeder cavity; and elevator means supported by the main frame for receiving particulate material from the feeder means and moving the particulate material rearwardly and upwardly to an overhead discharge position.

10. The sweeping means of claim 1 wherein the material collecting means comprises:

a roadway scraper blade; and material pusher means cooperating with the roadway scraper blade for pushing windrowed particulate material from the roadway up and over the roadway scraper blade and onto the first material lifting conveyor.

11. The sweeping means of claim 10 wherein the material pusher means comprises:

a slat conveyor characterized as having an endless chain belt supporting a plurality of slats that engage the particulate material on the roadway scraper blade and move the particulate material to the first material lifting conveyor.

12. The sweeping means of claim 10 wherein the material pusher means comprises:

a paddle wheel having a rotatable wheel drum supporting a plurality of radially extending slats that engage the particulate material on the roadway scraper blade and move the particulate material to the first material lifting conveyor.

13. The sweeping means of claim 1 wherein the residual material cleaning means further comprises:

rear brush means supported by the frame assembly at a position forward the ground scoop for sweepingly engaging the roadway surface and brushing residual particulate material into a residual windrow which is passed beneath the ground scoop as the frame assembly is moved forward.

14. The sweeping means of claim 13 wherein the rear brush means comprises:

a brush-supporting rear subframe;

a first rear brush assembly supported by the brush-supporting rear subframe and having a first rear brush rotatable about a substantially vertical rotational axis; and a second rear brush assembly supported by the brush supporting rear subframe and having a second rear brush rotatable about a substantially vertical rotational axis, the first and second rear brushes supported for counter-rotation and in spaced-apart spatial relationship so that residual particulate material engaged by the first and second rear brushes will be windrowed between the brushes.

15. The sweeping means of claim 14 wherein the rear brush means further comprises:

first rear linkage means for connecting the brush-supporting rear subframe and the first rear brush assembly; and second rear linkage means for connecting the brush-supporting rear subframe and the second rear brush assembly.

16. The sweeping means of claim 1 which further comprises:

a second material lifting conveyor having a first end and a second end, the first end of the second material lifting conveyor pivotally connected to the frame assembly such that the first end of the second material lifting conveyor is disposed below the second end of the first material lifting conveyor and adapted to receive particulate material discharged from the second end of the first material lifting conveyor; and second support placement means for supporting and positioning the second end of the second material lifting conveyor in a first mode in which the second end of the second material lifting conveyor is elevated, and for supporting and positioning the second end of the second material lifting conveyor in a second mode in which the second end is retracted.

17. The sweeping means of claim 13 wherein the residual material cleaning means further comprises:

a receiving hopper supported by the frame assembly for receiving collected residual material from the residual material conveying means, the receiving hopper having a bottom chute disposed therein such that the residual material in the receiving hopper is discharged from the hopper via the bottom chute onto the first material lifting conveyor.

18. The sweeping means of claim 17 wherein the residual material conveying means comprises:

overhead auger means for discharging the collected residual particulate material into the receiving hopper.

19. The sweeping means of claim 18 further comprising:

suction means disposed adjacent to the roadway for collecting by vacuum action the residual particulate material not transported to the residual material conveying means by the transverse brush assembly.

20. A front-end loader apparatus for removing particulate material from a roadway, the apparatus comprising:

a frame assembly having a main frame with a forward end and a rear end;

drive means for supporting and selectively driving the frame assembly over the roadway;

a brush-supporting forward subframe supported at the forward end of the main frame;

a first forward brush assembly supported by the brush-supporting forward subframe and having a first forward brush rotatably about a substantially vertical rotational axis;

a second forward brush assembly supported by the brush-supporting forward subframe and having a second forward brush rotatable about a substantially vertical rotational axis, the first and second forward brushes supported for counter-rotation and positioned in a spaced-apart spatial relationship so that particulate material on the roadway engaged by the first and second forward brushes will be incorporated into a windrow between the first and second brushes as the frame assembly moves forward;

feeder means supported at the forward end of the main frame for scooping up the windrow of particulate material and moving the scooped material in a rearward direction;

a first material lifting conveyor having a first end and a second end, the first end connected to the frame assembly in near proximity to the feeder means, the first material lifting conveyor adapted to receive the particulate material from the feeder means;

a flexible ground scoop supported beneath the frame assembly in sliding contact with the roadway surface and disposed to allow residual particulate material to pass therebeneath;

transverse brush means supported beneath the frame assembly for sweeping the residual particulate material forward and onto the ground scoop; and residual material conveying means, supported by the frame assembly, for receiving the residual particulate material contacted by the transverse brush means, the residual material conveying means elevating the residual particulate material to a position over the first material lifting coveyor.

21. The apparatus of claim 20 wherein the brush-supporting forward subframe is pivotally attached to the main frame, and the apparatus further comprises:

forward subframe positioning means for positioning the brush-supporting forward subframe between an extended mode in which the first and second forward brushes are positioned in contact with the roadway and a retracted mode in which the first and second forward brushes are positioned in clearing relationship to the roadway.

22. The apparatus of claim 21 wherein the brush-supporting forward subframe has a first side member and a second side member, and the windrow brush means further comprises:

first forward linkage means connecting the first side member and the first forward brush assembly, the first linkage means comprising:

a first right-hand vertical member connected to the first side member of the brush-supporting forward subframe;

a second right-hand vertical member connected to the first forward brush assembly; and a first parallelogram linkage disposed between and connecting the second right-hand vertical member to the first right-hand vertical member so that the rotational axis of the first forward brush is retained substantially vertical in the extended mode as the first forward brush is displaced vertically; and second forward linkage means connecting the second side member and the second forward brush assembly, the second linkage means comprising:

a first left-hand vertical member connected to the second side member of the brush-supporting forward subframe;

a second left-hand vertical member connected to the second forward brush assembly; and a second parallelogram linkage disposed between and connecting the second left-hand vertical member to the first left hand vertical member so that the rotational axis of the second forward brush is retained substantially vertical in the extended mode as the second forward brush is displaced vertically.

23. The apparatus of claim 22 wherein the first right-hand vertical member is pivotally connected to the first side member of the brush supporting forward subframe for pivotation about a substantially vertical axis, the second right-hand vertical member is pivotally connected to the brush-supporting forward subframe for pivotation about a substantially vertical axis, and the windrow brush means further comprises:

first forward brush pivoting means for yieldingly positioning the first right-hand vertical member at a predetermined angular disposition, the first forward brush pivoting means permitting the first forward brush to be angularly displaced within a predetermined arc of displacement relative to the brush-supporting forward subframe; and a second forward brush pivoting means for yieldingly positioning the first left-hand vertical member at a predetermined angular disposition, the second forward brush pivoting means permitting the second forward brush to be angularly displaced within a predetermined arc of displacement relative to the brush-supporting forward subframe.

24. The apparatus of claim 20 wherein the feeder means comprises:

a roadway scraper blade; and material pusher means cooperating with the roadway scraper blade for pushing windrowed particulate material over the roadway scraper blade and up and onto the first material lifting conveyor.

25. The apparatus of claim 24 wherein the material pusher means comprises:

a slat conveyor characterized as having an endless chain belt supporting a plurality of slats that engage the particulate material on the roadway scraper blade and move the particulate material to the first material lifting conveyor.

26. The apparatus of claim 24 wherein the material pusher means comprises:

a paddle wheel having a rotatable wheel drum supporting a plurality of radially extending slats that engage the particulate material on the roadway scraper blade and move the particulate material to the first material lifting conveyor.

27. The apparatus of claim 20 wherein the residual material cleaning means further comprises:

rear brush means supported by the frame assembly for sweepingly engaging the roadway surface and brushing residual particulate material into a residual windrow which is passed beneath the ground scoop as the frame assembly is moved forward.

28. The apparatus of claim 27 wherein the rear brush means comprises:

a brush-supporting rear subframe;

a first rear brush assembly supported by the brush-supporting rear subframe and having a first rear brush rotatable about a substantially vertical rotational axis;

a second rear brush assembly supported by the brush-supporting rear subframe and having a second rear brush rotatable about a substantially vertical rotational axis, the first and second rear brushes supported for counter-rotation and in spaced-apart spatial relationship so that residual particulate material engaged by the first and second rear brushes will be windrowed between the brushes.

29. The apparatus of claim 28 wherein the rear brush means further comprises:

first rear linkage means connected to the brush-supporting rear subframe and supporting the first rear brush assembly; and second rear linkage means connected to the brush-supporting rear subframe and supporting the second brush assembly.

30. The apparatus of claim 20 which further comprises:

support placement means for supporting and positioning the second end of the first material lifting conveyor in a first mode in which the second end is elevated, and for supporting and positioning the second end of the first material lifting conveyor in a second mode in which the second end is retracted.

31. The apparatus of claim 30 which further comprises:

a second material lifting conveyor having a first end and a second end, the first end of the second material lifting conveyor pivotally connected to the frame assembly such that the first end of the second material lifting conveyor receives particulate material discharged from the second end of the first material lifting conveyor; and support placement means for supporting the second end of the second material lifting conveyor in a first mode in which the second end of the second material lifting conveyor is elevated, and for supporting and positioning the second end of the second material lifting conveyor in a second mode in which the second end is retracted.

32. The apparatus of claim 27 wherein the residual material cleaning means further comprises:

a receiving hopper supported by the frame assembly for receiving collected residual material from the residual material conveying means, the receiving hopper having a bottom chute disposed therein such that the residual material in the receiving hopper is discharged therefrom via the bottom chute onto the first material lifting conveyor.

33. The apparatus of claim 27 wherein the residual material conveying means comprises:

overhead auger means for discharging the collected residual particulate material into the receiving hopper.

34. The apparatus of claim 26 further comprising:

suction means disposed adjacent to the roadway for collecting by vacuum action the residual particulate material not transported to the residual material conveying means by the transverse brush assembly.

35. A method for collecting particulate material scattered along a collection path on a roadway surface comprising the following steps in order:

(a) sweeping particulate material disposed along the collection path into a windrow substantially coincident with the collection path;

(b) collecting substantially all of the particulate material of the windrow by scooping said material onto a first material lifting apparatus as said material lifting apparatus is moved along the collection path;

(c) moving the collected particulate material on the first material lifting apparatus to an overhead discharge position;

(d) sweeping residual particulate material remaining on the roadway following step (b) into a residual windrow along the collection path;

(e) sweeping the residual particulate material of the residual windrow onto a second material lifting apparatus as said material lifting apparatus is moved along the collection path;

(f) moving the collected residual material on the second material lifting apparatus to the overhead discharge position so that the collected particulate material carried by the first material lifting apparatus and the collected residual material carried by the second material lifting apparatus are combined to form a combined discharge material; and (g) dropping the combined discharge material into a selected trailing receiving vehicle.

36. The method of claim 35 further comprising the step of vacuuming the roadway surface following step (d) to collect any material of the residual windrow not collected by step (d).

* * * * *